United States Patent [19]

Beer

[11] Patent Number: 5,030,159

[45] Date of Patent: Jul. 9, 1991

[54] ADJUSTABLE REED SOUNDER

[76] Inventor: Mark L. Beer, 201 Lafayette Ave.; Apt. 514, Petoskey, Mich. 49770

[21] Appl. No.: 450,533

[22] Filed: Dec. 14, 1989

[51] Int. Cl.[5] ..... A63H 5/00

[52] U.S. Cl. ..... 446/208; 446/207

[58] Field of Search ..... 446/207, 208, 209, 202, 446/203; 84/330

[56] References Cited

U.S. PATENT DOCUMENTS

| | | | |
|---|---|---|---|
| 350,521 | 10/1886 | Baldwin | 446/208 |
| 842,058 | 1/1907 | Bassett | 446/202 |
| 4,761,149 | 8/1988 | Laubach | 446/208 |

FOREIGN PATENT DOCUMENTS

| | | | |
|---|---|---|---|
| 520645 | 1/1956 | Canada | 446/207 |
| 615809 | 1/1949 | United Kingdom | 446/207 |

*Primary Examiner*—Mickey Yu

*Attorney, Agent, or Firm*—Michael I. Kroll

[57] ABSTRACT

A monster call is provided and consists of an elongated reed centrally positioned in a passageway between a pair of side walls and extending between a pair of end walls of a rectangular shaped body. A person can place their lips over the passageway and blow air therethrough to cause the reed to vibrate, thereby generating a simulated sound of a monster.

3 Claims, 1 Drawing Sheet

Fig. 1
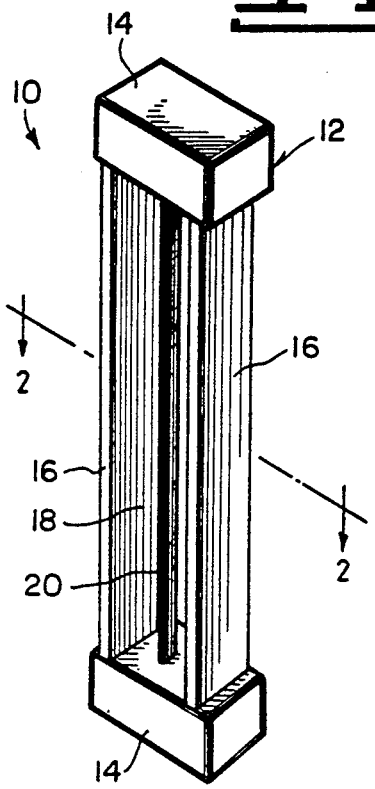
Fig. 2
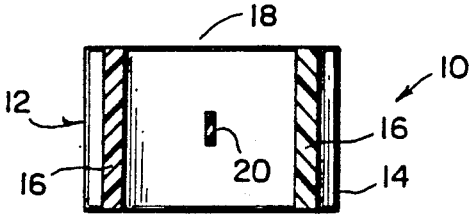
Fig. 3
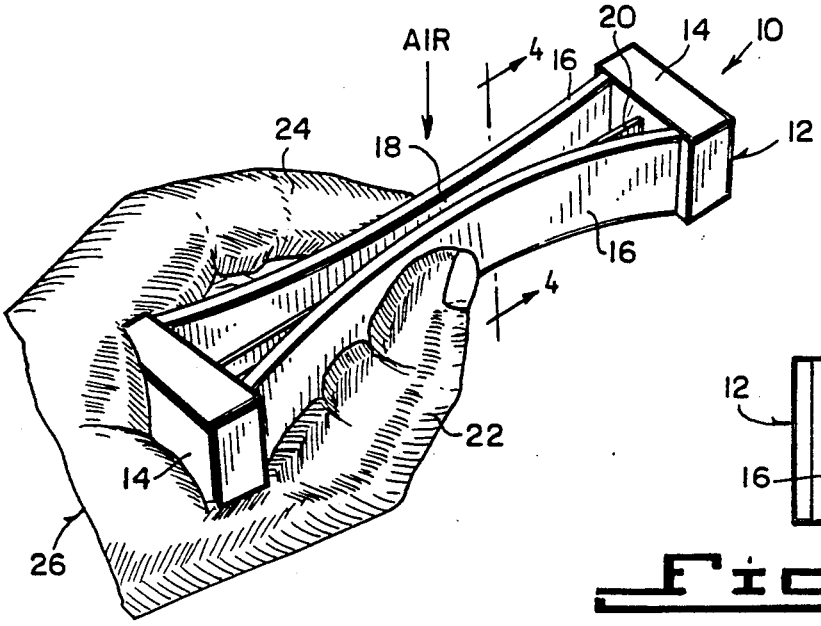
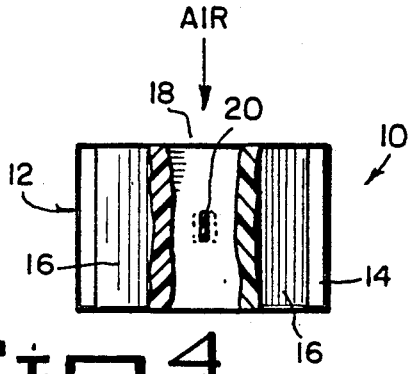
Fig. 4

ADJUSTABLE REED SOUNDER

BACKGROUND OF THE INVENTION

1. Field of the Invention

The instant invention relates generally to musical devices and more specifically it relates to a monster call.

2. Description of the Prior Art

Numerous musical devices have been provided in prior art that are adapted to be used in conjunction with the mouth and to be operated to produce sounds by blowing through the devices. For example, U.S. Pat. Nos. 350,521 to Baldwin; 795,493 to Ditto; 1,052,525 to Smith; 2,133,440 to Fortuna; 3,656,258 to Thomas and 4,483,097 to Piper all are illustrative of such prior art. While these units may be suitable for the particular purpose to which they address, they would not be as suitable for the purposes of the present invention as heretofore described.

SUMMARY OF THE INVENTION

A primary object of the present invention is to provide a monster call that will overcome the shortcomings of the prior art devices.

Another object is to provide a monster call that will produce a different sound every time a person squeezes it and blows air from their mouth therethrough.

An additional object is to provide a monster call that can be used as a continued source of entertainment for children as well as adults.

A further object is to provide a monster call that is simple and easy to use.

A still further object is to provide a monster call that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view of the invention.

FIG. 2 is a cross sectional view taken along line 2—2 in FIG. 1.

FIG. 3 is a perspective view of the invention gripped and squeezed in a hand of a user.

FIG. 4 is a cross sectional view taken along line 4—4 in FIG. 3.

DETAILED DESCRIPTION OF THE PREFERRED EMBODIMENTS

Turning now descriptively to the drawings, in which similar reference characters denote similar elements throughout the several views, the Figures illustrate a monster call 10 consisting of a rectangular shaped body 12 having a pair of spaced apart short end walls 14 and a pair of parallel spaced apart elongated side walls 16 extending between the end walls 14 to form a passageway 18 for air to flow therethrough. An elongated reed 20 is centrally positioned in the passageway 18 between the side walls 16 and extends between the end walls 14. A person can place their lips over the passageway 18 and blow air through the passageway to cause the reed

20 to vibrate, thereby generating a sound which will simulate the sound of a monster.

The side walls 16 are fabricated out of flexible material so that when the person grips the side walls 16 between a thumb 22 and index finger 24 of a hand 26, as shown in FIG. 3, and squeezes the side walls 16 together the reed 20 will vibrate differently, thus generating different simulated monster sounds. The side walls 16 are fabricated out of durable flexible plastic material while the end walls 14 are fabricated out of non-flexible durable plastic material. The elongated reed 20 is fabricated out of a thin band of rubber material.

When the side walls 16 are squeezed together to almost touch the reed 20 the person should then put the passageway 18 up to the mouth and blow straight through or at an angle. Every time this is done it will produce a very strange simulated shriek, moan, groan, howl, or just a plain strange sound thus creating many bizarre sounds.

LIST OF REFERENCE NUMBERS

10—monster call of the present invention
12—rectangular shaped body
14—short end walls
16—elongated side walls
18—passageway
20—elongated reed
22—thumb
24—index finger
26—hand It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A monster call, comprising:

(a) an elongated reed;

(b) a rectangular shaped body having a pair of spaced apart short end walls and a pair of spaced apart elongated side walls extending between said pair of spaced apart short end walls to form a passageway for air to flow therethrough, said rectangular body having a normal position and a squeezed position, in said normal position said pair of spaced apart side walls are straight and parallel, in said squeezed position said pair of spaced apart side walls are concaved which causes said pair of spaced apart short end walls to come towards each other and contract said reed, said pair of spaced apart side walls are fabricated out of flexible material so that when the person grips said pair of spaced apart side walls between a thumb and an index finger of a hand and squeezes said pair of spaced apart side walls said rectangular body assumes said squeezed position, said elongated reed vibrating and generating simulated monster sounds without needing to bite down on said pair of spaced apart side walls but merely having to place the lips of the user over said passageway and blow to cause said reed to vibrate, said elongated reed being centrally positioned in said passageway between said pair of spaced apart side walls and extending between said pair of spaced apart short end walls.

2. A monster call as recited in claim 1, wherein said pair of parallel spaced apart side walls are fabricated out of durable flexible plastic material while said pair of spaced apart short end walls are fabricated out of non-flexible durable plastic material.

3. A monster call as recited in claim 2, wherein said elongated reed is fabricated out of a thin band of rubber material.

* * * * *